US009169625B2

(12) United States Patent
Chiu et al.

(10) Patent No.: US 9,169,625 B2
(45) Date of Patent: Oct. 27, 2015

(54) WATER-SAVING MANAGEMENT SYSTEM FOR SANITARY FACILITY AND WATER-SAVING MANAGEMENT METHOD FOR SANITARY FACILITY

(75) Inventors: Yuan-Ye Chiu, New Taipei (TW); Ching-Hsien Ying, New Taipei (TW); Heng-Yen Liu, New Taipei (TW)

(73) Assignee: ALLIANCE SERVICE INTERNATIONAL CORPORATION, New Taipei (TW)

( * ) Notice: Subject to any disclaimer, the term of this patent is extended or adjusted under 35 U.S.C. 154(b) by 500 days.

(21) Appl. No.: 13/598,014

(22) Filed: Aug. 29, 2012

(65) Prior Publication Data

US 2013/0047327 A1 Feb. 28, 2013

(30) Foreign Application Priority Data

Aug. 30, 2011 (TW) ..... 100131160 A

(51) Int. Cl.
*E03D 1/00* (2006.01)
*E03C 1/05* (2006.01)
*E03D 5/10* (2006.01)

(52) U.S. Cl.
CPC ..... *E03C 1/057* (2013.01); *E03D 5/105* (2013.01); *E03D 1/00* (2013.01)

(58) Field of Classification Search
CPC ..... E03D 1/14
USPC ..... 4/300–442
See application file for complete search history.

(56) References Cited

FOREIGN PATENT DOCUMENTS

| | | | |
|---|---|---|---|
| CN | 1079524 | A | 12/1993 |
| CN | 201395853 | Y | 2/2010 |
| JP | 2008291460 | A | 12/2008 |

OTHER PUBLICATIONS

China Patent Office, Office Action, Patent Application Serial No. CN201110261455.5, Dec. 2, 2013, China.
China Patent Office, Office Action issued on Jul. 10, 2014.

*Primary Examiner* — Lori Baker
(74) *Attorney, Agent, or Firm* — Rabin & Berdo, P.C.

(57) ABSTRACT

A water-saving management system for a sanitary facility and a water-saving management method for a sanitary facility are provided. A control device is connected to flush valves corresponding to sanitary facilities of one or more sanitary spaces. The control device outputs flush-associated data to a local server via a transmission network. The local server receives the flush-associated data and transfers mode setting data via the transmission network. The control device sets a flush mode according to the mode setting data, so as to flush the sanitary facilities.

20 Claims, 8 Drawing Sheets

| Mode setting data | Forward flush in seconds | Backward flush in seconds | Interval flush in seconds | Repeated person-time |
|---|---|---|---|---|
| Flush mode/Example 1 | 1 | 10 | 0 | 1 |
| Flush mode/Example 2 | 0 | 3 | 0 | 4 |
| Flush mode/Example 3 | 0 | 3 | 0 | 9 |

FIG. 2A

| | |
|---|---|
| Time segment TS | 3 |
| Time period TP | 16-17 |
| Execution person-time in intelligent water-saving AP | 6 |
| Ttime of forward flush TF | 1 |
| Time of backward flush TB | 20 |
| Time of automatic backward flush ATB | 10 |
| Time of automatic clean flush interval AF | 30 |
| Flush time for automatic clean flush AFF | 20 |

FIG. 2C

WATER-SAVING MANAGEMENT SYSTEM FOR SANITARY FACILITY AND WATER-SAVING MANAGEMENT METHOD FOR SANITARY FACILITY

CROSS-REFERENCES TO RELATED APPLICATIONS

This non-provisional application claims priority under 35 U.S.C. §119(a) on Patent Application No. 100131160 filed in Taiwan, R.O.C. on 2011/08/30, the entire contents of which are hereby incorporated by reference.

BACKGROUND OF THE INVENTION

1. Technical Field

The present invention relates to a water-saving system, and particularly, to a water-saving system applied to a sanitary facility.

2. Related Art

To achieve the purpose of cleaning, a flush control mechanism is generally connected above a urinal funnel arranged in a sanitary space; the flush control mechanism has a sensor that can detect a user standing before the urinal funnel. In use, after the sensor detects a user for some time, the flush control mechanism starts a flush valve to release a particular volume of water to flush the urinal funnel for the first time, which is the so-called "forward flush". When the sensor detects that the user leaves, that is, after the user finishes toileting, the flush control mechanism controls restarting of the flush valve, so as to release another particular volume of water to flush the urinal funnel for the second time, which is the so-called "backward flush". The above is the basic mode in which the flush control mechanism performs flush control in the case of a single user.

When a number of users continually use the urinal funnel, the conventional urinal funnel flush control mechanism also has a setting of canceling the forward flush, which can save a large volume of water.

However, the water supply mode provided by the conventional flush control mechanism is mainly based on the factory setting, and is not easy to change. Moreover, too many variables such as the number of users n the spot, a urine output volume, and a use interval and frequency exist and are not easy to measure and track. Therefore, the fixed water supply mode cannot completely suit the use on the spot. In most cases, the water supply mode preset for the urinal funnel still exceeds a water volume required by cleaning the urinal funnel, so a problem of lots of waste still exists.

SUMMARY

In view of the problem in prior art, an embodiment of the present invention provides a water-saving management system for a sanitary facility, for controlling one or more flush valves to flush a corresponding sanitary facility or corresponding sanitary facilities, where the flush valves and the corresponding sanitary facilities are located in one or more sanitary spaces. The water-saving management system for a sanitary facility includes one or more control devices connected to the flush valves corresponding to the sanitary facilities. The control device includes a network module, a sensing module, and a processing module. The network module is connected to a transmission network; the sensing module senses a user before the sanitary facility and generates a sensing signal; and the processing module electrically connects the flush valve, the network module, and the sensing module, and has one or more flush modes to control the flush valve to flush the sanitary facility, and the processing module receives the sensing signal and outputs flush-associated data via the network module. The control device receives mode setting data transferred via the transmission network, and sets the flush mode according to the mode setting data.

In another embodiment of the present invention, the control device has a plurality of flush modes, and the control device switches to one of the flush modes according to the mode setting data. In another embodiment, the control device has a plurality of flush modes, the mode setting data includes one or more context parameters corresponding to one of the flush modes, and the control device flushes the sanitary facility according to the one of the flush modes corresponding to the context parameter; the context parameter is selected from one of the following group or any combination of: a place factor, a time factor, an actual measurement factor, an event factor, and a building use factor. Besides, the sanitary facility is selected from one of the following group or any combination of: a urinal funnel, a water tap, and a closestool.

In another embodiment of the present invention, a water-saving management system for a sanitary facility is provided, which includes a transmission network, a plurality of control devices, and a local server. The control devices are connected to a plurality of flush valves corresponding to sanitary facilities of a plurality of sanitary spaces; the control devices include a network module, a sensing module, and a processing module. The flush valve connects an external water source and the sanitary facility; the network module is connected to a transmission network; the sensing module detects a user before the sanitary facility and generates a sensing signal; the processing module electrically connects the flush valve, the network module, and the sensing module, and has one or more flush modes to control the flush valve to flush the sanitary facility, and the processing module receives the sensing signal and outputs flush-associated data via the network module. The local server is connected to the control device via the transmission network, the local server receives the flush-associated data and transfers mode setting data via the local network, and the control device sets the flush mode according to the mode setting data to flush the sanitary facility. In another embodiment of the present invention, the mode setting data is based on one or any combination of: a place where the sanitary facility and the sanitary space are located, time, the number of actually measured persons, a relevant event, and a building use. The local server can calculate and output, according to the flush-associated data of the control device, one or any combination of: a water-saving volume, a water use volume, and a water fee. The water-saving management system for a sanitary facility according to the present invention may further include a central server connected to the local server via the Internet, where the local server transfers the flush-associated data to the central server.

In another embodiment of the present invention, a water-saving management method for a sanitary facility is provided, which is applied to a sanitary facility of a sanitary space. The method includes: connecting a control device to a transmission network, where the control device is connected to a flush valve corresponding to the sanitary facility; outputting flush-associated data of the control device to the transmission network; receiving by the transmission network mode setting data transferred to the control device; and setting a flush mode of the control device according to the mode setting data. The flush-associated data is transferred to a local server via the transmission network, and the mode setting data is transferred by the local server to the control device via the transmission network.

A further embodiment of the present invention provides a water-saving management method for a sanitary facility, including: providing a control device connected to a flush valve corresponding to a sanitary facility; and controlling the flush valve for flushing according to a plurality of pieces of mode setting data of the control device, where the mode setting data is selected from one of the following group or any combination of: a flush time setting parameter, an execution person-time setting parameter, and a period/point-of-time setting parameter.

BRIEF DESCRIPTION OF THE DRAWINGS

The present invention will become more fully understood from the detailed description given herein below for illustration only, and thus are not limitative of the present invention, wherein:

FIG. 2A is an example of mode setting data according to another embodiment of the present invention;

FIG. 2C is an example of part of mode setting data in the embodiment of FIG. 2B;

DETAILED DESCRIPTION

Figure 1:
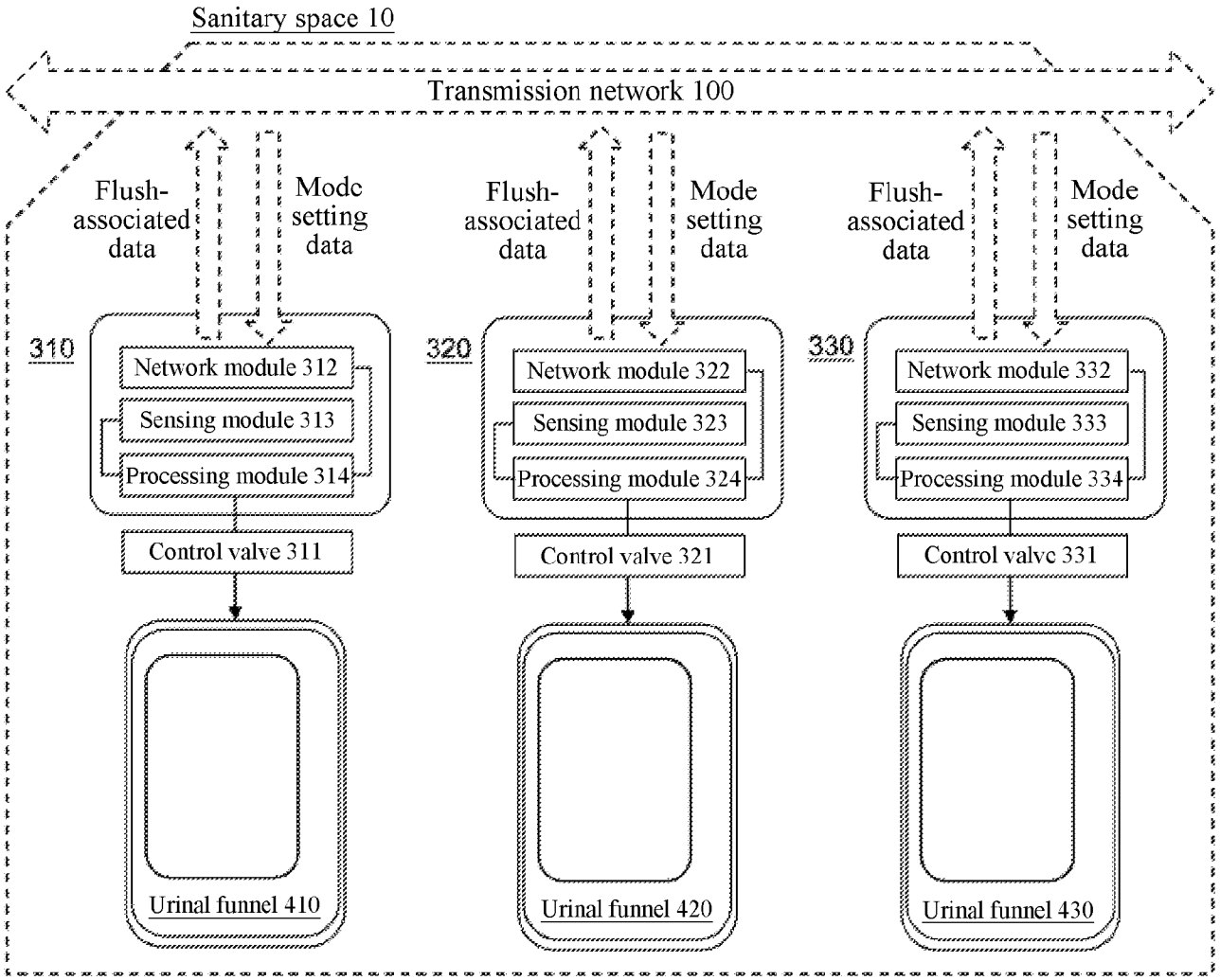
FIG. 1 is a system block diagram of a water-saving management system for a sanitary facility according to an embodiment of the present invention.

FIG. 1 is a system block diagram of a water-saving management system for a sanitary facility according to an embodiment of the present invention. Referring to FIG. 1, the water-saving management system for a sanitary facility is mainly installed in a sanitary space 10, which mainly includes one or more control devices (310, 320, and 330 in FIG. 1). The control devices 310, 320, and 330 are connected to a flush valve 311, 321, and 331 corresponding to urinal funnels 410, 420, and 430 (sanitary facilities) of the sanitary space 10 respectively. Each flush valve 311/321/331 is connected to an external water source (not shown) and a corresponding urinal funnel 410/420/430. The flush valve 311/321/331 is a waterway control valve (for example, an electromagnetic valve), which is opened or closed to control the time and frequency of flushing the urinal funnel 410/420/430.

Each control device 310/320/330 has a network module 312/322/332, a sensing module 313/323/333, and a processing module 314/324/334.

The network module 312/322/332 is connected to a transmission network 100. The transmission network 100 may be a private network or a public network formed by wired or wireless architecture, and the private or public network may be partially selectively connected via the Internet. The network module 312/322/332 may be a wired network transmission module, used for connection and transmission through technologies such as a phone line, a Cable TV, an Ethernet local area network (LAN), a VGA transmission line, an AV signal transmission line, a Power Line Communication (PLC), a coaxial cable network, a fiber network, an Ethernet, and a telecommunications network module such as Digital Subscriber Line (DSL)/Integrated Services Digital Network (ISDN)/Asymmetric Digital Subscriber Loop. The network module 312/322/332 may also be a wireless network transmission module, used for connection and transmission through technologies such as a Wireless LAN (for example, any version conforming to the IEEE802.11 standard), a Wireless AV, Bluetooth transmission, Ultra-Wide Band (UWB) transmission, Zigbee wireless transmission, Wi-Fi wireless transmission, Worldwide Interoperability for Microwave Access (WiMAX), mobile phone transmission (GSM, CDMA, WCDMA, CDMA2000, TDS-CDMA, . . . ), digital TV transmission (DVB-Cable, Satellite, Terrestrial), analog TV signal transmission (UHF, VHF), and broadcast signal transmission (FM, AM).

The sensing module 313/323/333 may be an infrared sensor, an ultrasonic sensor, an optical sensor, a thermal sensor, an image sensor, and the like, for detecting a user entering or leaving a sensing region and generating a sensing signal. Generally, the sensing region of the sensing module 313/323/333 is within a particular distance in front of the urinal funnel 410/420/430, and whether the user enters or leaves the sensing region, the sensing module 313/323/333 can generate a sensing signal respectively.

The processing module 314/324/334 respectively electrically connects the flush valve 311/321/331, the network module 312/322/332, and the sensing module 313/323/333. The processing module 314/324/334 each has a plurality of flush modes. After receiving the sensing signal, the processing module controls the time and frequency of starting the flush valve 311/321/331 through the flush mode, thereby controlling the flush water volume of the urinal funnel 410/420/430. The processing module 314/324/334 receives the sensing signal, for determining or recording the number of users and use time, and a flush mode in the flushing, a forward flush volume, a backward flush volume, and a total water use volume can be recorded as "flush-associated data" along with the number of users, the use time, even an identification code and a location code of the urinal funnel. In an embodiment, the transmitted flush-associated data may be message packets formed by data such as device identification codes, entering/leaving indication codes (entering or leaving the sensing region), and an entering/leaving time. The flush-associated data may be output by the processing module 314/324/334 to the transmission network 100 via the network module 312/322/332. Through the transmission network 100, each control device 310/320/330 of the water-saving management system for a sanitary facility can be provided with remote control and setting. The processing module according to the present invention may include a memory unit to store the flush-associated data and mode setting data or a context parameter.

One or more "mode setting data" may be transmitted to each processing module 314/324/334 via the transmission network 100 and the network module 312/322/332 of the control device 310/320/330. FIG. 2A is an example of mode setting data according to an embodiment of the present invention. Example 1 is one of the most common flush modes; each time the sensing module 313/323/333 senses the user, forward flush is performed for 1 second and backward flush is performed for 10 seconds after use. Example 2 is that in the case of many successive users (for example, the number of persons is 5 in intelligent water-saving), forward flush is not performed and backward flush is performed for the first person to the fourth person, and the number of seconds in which backward flush is performed can be adjusted or reduced, to significantly decrease the water volume; but forward flush and backward flush like those in Example 1 recovers for the fifth person and after that. Example 3 is that in the case of more successive users (for example, the number of persons is 10 in intelligent water-saving), forward flush is not performed and backward flush is performed for the first person to the ninth person, to significantly decrease the water volume; but complete forward flush and backward flush like those in Example 1 recovers for the tenth person and after that.

Figure 2B:
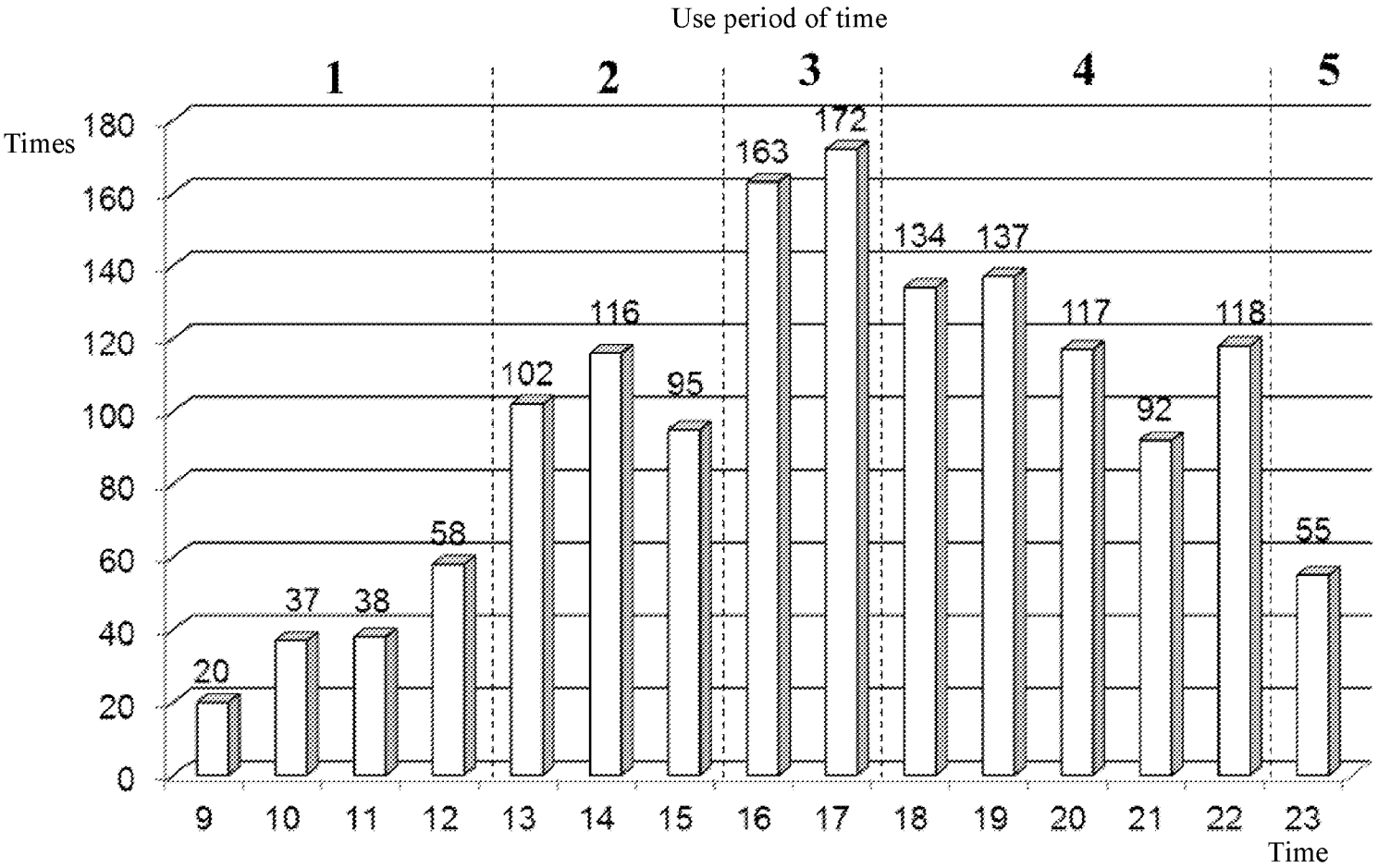
FIG. 2B is a diagram of using times of a urinal funnel actually measured in a male toilet in a building W at 9:00-23:00 on a certain day according to another embodiment of the present invention.

In another embodiment, the flush water volume is controlled through stricter parameters. FIG. 2B is a diagram of using times of a urinal funnel in a male toilet in a building W at 9:00-23:00 in a certain day according to another embodiment of the present invention. The attribute of the building W is a public film entertainment building, and the using times and time of the male toilet on the second floor may be affected by factors such as the film box office, show time, and after-show time. In this embodiment, the flush water volume control model used by the water-saving management system for a sanitary facility is:

f (Volume)=f (P, Ø, TF, TB, AP, ATB, TS, TP, AF, AFF, TO, TC)

where:

P: flush water pressure of the sanitary facility; the pressure is generally 0-5 kg/cm$^2$, and needs to be kept the same at respective floors;

Ø: water pipe diameter of the sanitary facility; according to the unified national standard, a pipe diameter of the urinal funnel is 1.2 cm, and a pipe diameter of the closestool is 2.54 cm;

TF: forward flush time, in seconds;

TB: backward flush time, in seconds;

AP: execution person-time in intelligent water-saving, that is, in the intelligent water-saving mode, set person-time of users experienced when the water-saving mode is executed;

ATB: intelligent backward flush time; that is, backward flush time in the intelligent water-saving mode, in seconds;

TS: time segment, for differentiating between high and low peak time sections;

TP: time period, for differentiating between intervals from one time of point to another time of point in a particular time segment;

AF: automatic clean flush interval, generally in minutes; in the intelligent water-saving mode, an interval between time when the urinal funnel is not used by the previous user and time when the urinal funnel is not used by the following user; once the interval during which the urinal funnel is not used after the previous user leaves and before the following user enters reaches a preset value, the water-saving management system for a sanitary facility performs automatic flush;

AFF: flush time for automatic clean flush, in seconds;

TO: automatic opening time of the urinal funnel;

TC: automatic closing time of the urinal funnel.

Since for the public place, factors such as overall water use volume and fire water supply needs to considered, water pressure (P) at each floor must be kept the same in building planning and design. Pipe diameters of the urinal funnel and closestool water pipes conform to the unified national standards, the two parameters are fixed coefficients. That is to say, the management system for a sanitary facility in this embodiment performs control mainly through three kinds of setting parameters of the mode setting data:

flush time setting parameter, including one of the following group or any combination of: forward flush time TF, backward flush time TB, intelligent backward flush time ATB, and flush time for automatic clean flush AFF;

execution person-time setting parameter, at least including execution person-time in intelligent water-saving AP; and period/point-of-time setting parameter, including one of the following group or any combination of: time segment TS, time period TP, automatic clean flush interval AF, opening time TO, and closing time TC parameters.

For the water-saving management system for a sanitary facility according to the present invention, the mode setting data is not limited to the above three kinds of setting parameters: the flush time setting parameter, the execution person-time setting parameter, and the period/point-of-time setting parameter, and is not limited to specifics of the setting parameters listed above.

Figure 4A:
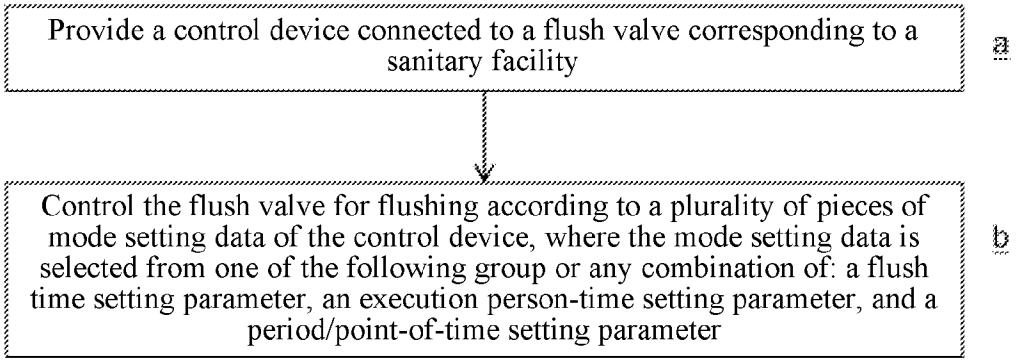
FIG. 4A is a flow chart of a water-saving management method for a sanitary facility according to another embodiment of the present invention.

FIG. 2C is taken as an example. FIG. 2C is an example of part of mode setting data of the water-saving management system for a sanitary facility in the embodiment of FIG. 2B. Referring to FIG. 2B and FIG. 2C, the time segment TS is at the third period of time, and the time period TP is from 16:00 to 17:00; it can be viewed from FIG. 2B that the third period of time (that is, from 16:00 to 17:00) is a peak use period of time on that day. In the period of time, the setting of the water-saving management system for a sanitary facility is: the person-time in intelligent water-saving AP is 6, that is, 6 persons are selected to use the intelligent water-saving mode. According to the setting, the forward flush time TF is 1 second, but the first person to the fifth person do not perform forward flush, and only perform backward flush with the intelligent backward flush time ATB of 10 seconds. When the sixth person uses, it is completely restored that the forward flush time TF is 1 second and the backward flush time TB is 20 seconds. After the previous user leaves and before the following user enters, the urinal funnel is not used in an interval of 30 minutes (that is, the automatic clean flush interval AF is 30 minutes), that is, according to the setting, the flush time for automatic clean flush AFF is 20 seconds. FIG. 4A is a flow chart of a water-saving management method for a sanitary facility according to an embodiment of the present invention. Based on the above embodiments, the water-saving management method for a sanitary facility mainly includes: (a) providing a control device to be connected to a flush valve corresponding to a sanitary facility; and (b) controlling the flush valve for flushing according to a plurality of pieces of mode setting data of the control device, where the mode setting data is selected from one of the following group or any combination of: a flush time setting parameter, an execution person-time setting parameter, and a period/point-of-time setting parameter.

Additionally, in order to achieve the best water-saving effect, the flush-associated data is accumulated and tracked in a variety of contexts for a long time, which contributes to analyzing and designing flush modes for different contexts, so as to achieve the best water-saving effect. A department store is taken as an example. A number of factors may affect the use of the urinal funnel in sanitary spaces such as toilets.

Overall, the use frequency of the sanitary space is affected by one or more of the following factors.

(1) Place: in a hospital hall, a clinic floor, a ward floor, a restaurant/food street floor, a men's clothing floor, a women's clothing floor, a children's clothing floor, a women and children floor, an entertainment goods floor, a home appliances 3C floor, and a film floor, due to different ethnic groups of consumers, different consumer behaviors and the different numbers of persons, different usage behaviors may exist in the sanitary space/toilet at the floor or nearby.

(2) Time: due to the influence of factors such as a business period of time, meal time, a film start/finish period of time, and season change, the use conditions of the urinal funnel are different.

(3) Event: a promotional activity such as an anniversary celebration, a family activity, a sporting event, a box office figure, and the like may also affect the number and the ethnic group of the urinal funnel users.

(4) The number of actually measured persons: if the number of persons detected at the entrance of the toilet/sanitary space in a unit time is greatly increased, it indicates that the urinal funnel will be used frequently; the more the number of persons entering the toilet/sanitary space in a short time is, the higher the use frequency is. The entrance of the sanitary space may be provided with a sensing module, a processing module, and a network module, so as to output a sensing signal (for example, control device 300 in FIG. 5) when detecting the number of persons in real time to the transmission network 100. The number of persons entering the building may also be listed as a kind of the number of actually measured persons.

The above influence factors are tracked and analyzed for a long time to form context parameters with a place factor, a time factor, an actual measurement factor, and an event factor as variables, where each context parameter has a corresponding flush mode, to facilitate switch in the control of the whole urinal funnel water-saving management system. Briefly, the control device 310/320/330 can switch different flush modes or change the setting of the flush mode according to one or any combination of: a place where the urinal funnel and the sanitary space are located, time, the number of actually measured persons, a relevant event, and a building use.

Therefore, one or more "context parameters" may be transmitted to each processing module 314/324/334 via the transmission network 100 and the network module 312/322/332 of the control device 310/320/330, and each context parameter corresponds to at least one of the flush modes. In this way, each processing module 314/324/334 can switch to a flush mode corresponding to the context parameter, and flushing the urinal funnel 410/420/430 in a flush mode in conformity with an actual context naturally can save improperly wasted water. The context parameter may be selected from one of the following group or any combination of: a place factor, a time factor, an actual measurement factor and an event factor. A form of the context parameter may be a code with characters and/or digits combined or a group of multi-field digits similar to the mode setting data, and is delivered via the transmission network.

Figure 3:
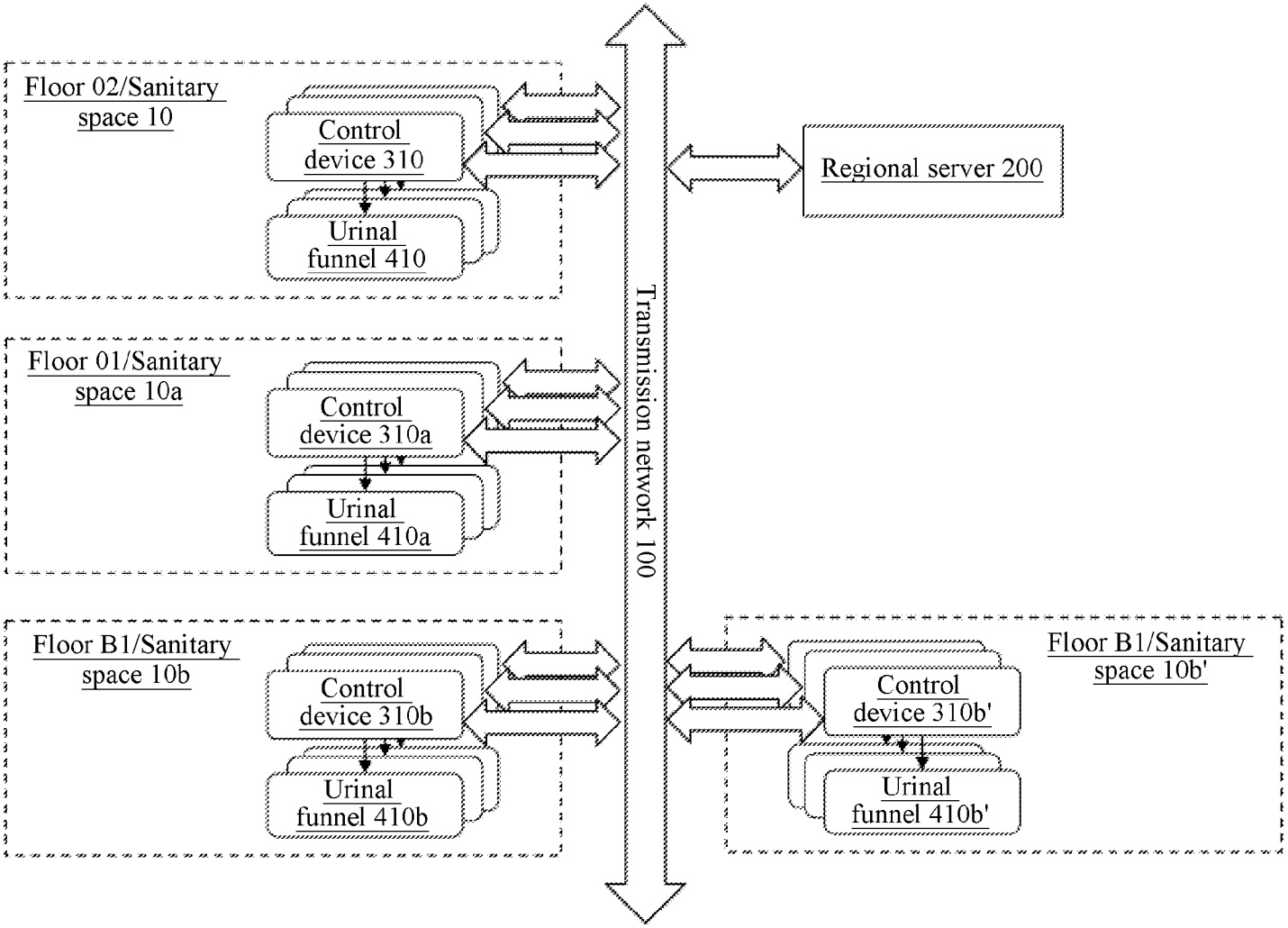
FIG. 3 is a system block diagram of a water-saving management system for a sanitary facility according to another embodiment of the present invention.

FIG. 3 is a system block diagram of another water-saving management system for a sanitary facility according to another embodiment of the present invention. In this embodiment, the water-saving management system for a sanitary facility includes sanitary spaces and urinal funnels disposed at different floors in one (or more) building, and performs remote control via a local server; if more than one sanitary space and urinal funnel are arranged at the same floor, connection also can be performed via a transmission network. In FIG. 3, the local server 200 is connected via the transmission network 100 to the control device 310/310*a*/310*b*/310*b*' of different sanitary spaces 10/10*a*/10*b*/10*b*' at different floors B1/01/02, and each control device 310/310*a*/310*b*/310*b*' is correspondingly mounted on the urinal funnel 410/410*a*/410*b*/410*b*' in the sanitary spaces 10/10*a*/10*b*/10*b*'. As buildings have different "building use," for example, a living and working building, a pure office building, and a department store, the use forms of the urinal funnels in the private/public sanitary space are different, and different flush modes need to be supplemented to achieve the best water-saving effect. Therefore, the system architecture in this embodiment is beneficial to monitoring and managing the water-saving system arranged in the private or public sanitary space of the building by the building owner. The "building use factor" of the building can be served as a variable of the context parameters; in short, as long as an appropriate flush mode is designed for the "building use," the control device can set the flush mode according to the "building use."

The local server 200 collects and records flush-associated data of each control device 310/310*a*/310*b*/310*b*', provides a chart integration interface to collect or calculate relevant data such as a water use volume and a water-saving volume of each sanitary space, each control device, and even each building, and provides a water-saving management interface for the owner to set "mode setting data" and "context parameters," so as to facilitate remote setting, change or modification of the flush mode of each control device 310/310*a*/310*b*/310*b*'.

The processing module 314/324/334 of the control device 310/320/330 in FIG. 1 may only simply collect raw data of the flush-associated data, to be directly returned to the local server 200 in FIG. 3 for judgment or calculation.

The local server 200 can receive and record respective flush-associated data related to different urinal funnels 410/410*a*/410*b*/410*b*' transferred from the control devices 310/310*a*/310*b*/310*b*' of different sanitary spaces 10/10*a*/10*b*/10*b*' at different floors B1/01/02. The local server 200 can respectively transfer different mode setting data or context parameters to the control device 310/310*a*/310*b*/310*b*' through the transmission network 100 to set, change, or modify the flush mode.

A system service provider may dispose a central server, for receiving sensing data from multiple buildings/public sanitary spaces/flush control devices via the Internet and multiple local servers at different locations; the central server can be installed with an execution program similar to that of the local server, and performs remote operations with the water-saving management method for a sanitary facility according to the embodiment of the present invention.

Figure 5:
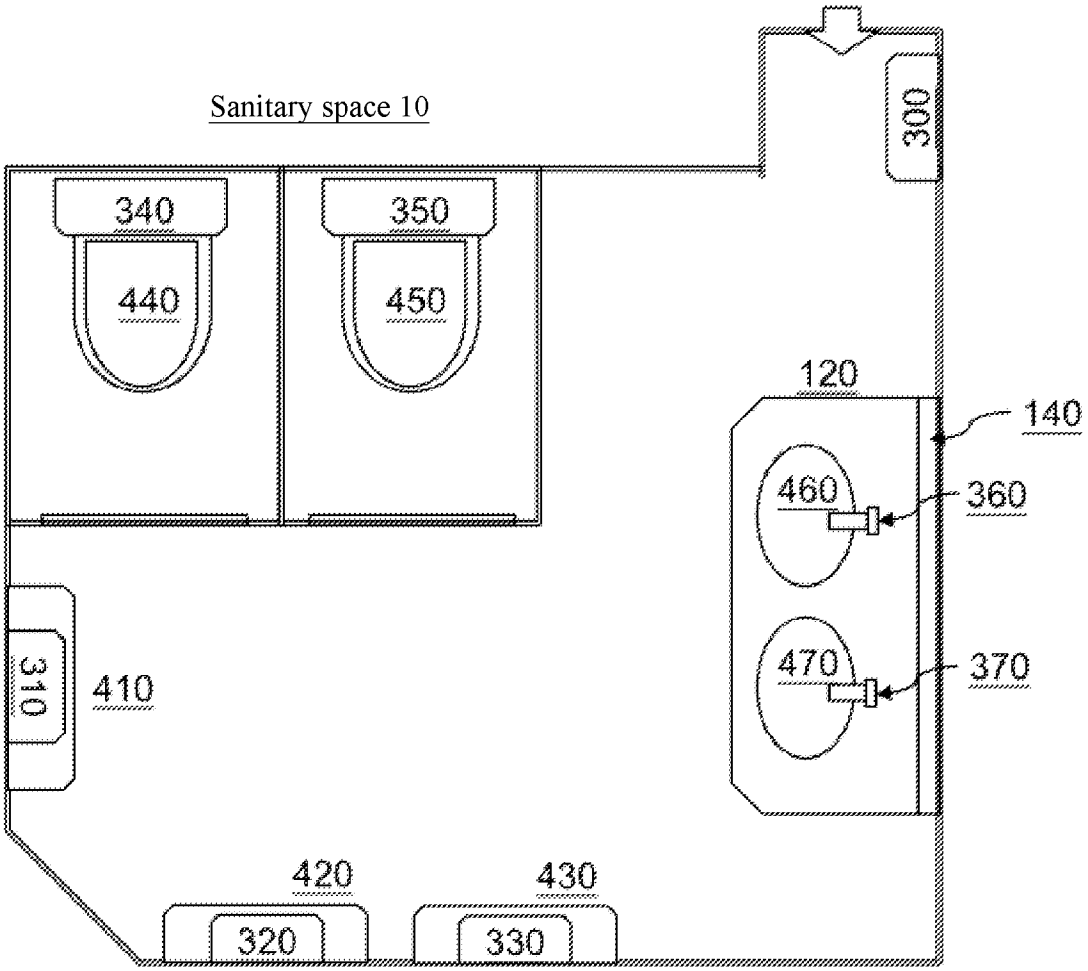
FIG. 5 is a schematic view of arrangement of a water-saving management system for a sanitary facility in a sanitary space according to another embodiment of the present invention.

Although a urinal funnel installed with a sensing control device is taken as an example of the sanitary facility in the foregoing embodiment, the technology disclosed in the embodiment of the present invention may be applicable to a water tank on a hand-washing table (the control device is a sensing tap, and the sanitary facility is the water tank) or a sensing closestool in the sanitary space. An embodiment of the sensing tap is the control device 360/370 as shown in FIG. 5. The sensing tap is located on the hand-washing table 120 before the mirror 140, and the sanitary facility corresponding to the sensing tap is a water tank 460/470. An embodiment of the sensing closestool is the sensing closestool 440/450 as shown in FIG. 5, and the control device 340/350 controls water supply of the sanitary facility (that is, the sensing closestool 440/450).

Figure 4B:
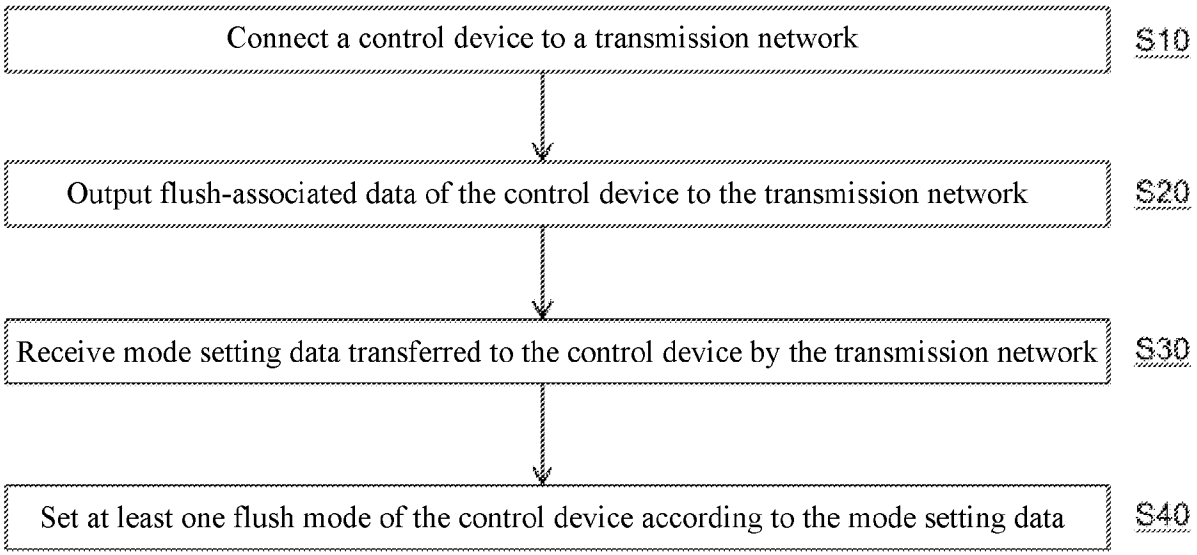
FIG. 4B is a flow chart of a water-saving management method for a sanitary facility according to another embodiment of the present invention.

FIG. 4B is a flow chart of a water-saving management method for a sanitary facility according to another embodiment of the present invention. The water-saving management method for a sanitary facility in this embodiment is a computer executable program, applied to the water-saving management system for a sanitary facility according to the present invention, where the water-saving management system for a sanitary facility includes a control device connected to a flush valve corresponding to a sanitary facility in a sanitary space, and the method includes the following actions:

S10: Connect a control device to a transmission network, where the control device is connected to a flush valve corresponding to a sanitary facility. After the control device is turned on, a flush control program built in the control device is executed, so that the control device is connected to the transmission network via a network module of the control device.

S20: Output flush-associated data of the control device to the transmission network; and S30: receive mode setting data transferred by the transmission network to the control device. When a local server and the transmission network are in an on-line state, the local server may receive the flush-associated data from the control device and transfer the mode setting data to the control device via the transmission network.

S40: Set a flush mode of the control device according to the mode setting data. The control device can set (switch and modify) its flush mode according to the mode setting data transferred from the local server, and flushes the sanitary facility with a flush frequency and water volume that better suit the use.

Actions S10/S20/S30/S40 illustrated with a flow chart in FIG. 4B are only exemplary, and according to the water-saving management system for a sanitary facility and the water-saving management method for a sanitary facility according to the present invention, the actions executed by the flush control program built in the foregoing control device are not limited to the execution order in FIG. 4B.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A water-saving management system for a sanitary facility, for controlling at least one flush valve to flush a corresponding sanitary facility, the water-saving management system for a sanitary facility comprising:

at least one control device, connected to the flush valve corresponding to the sanitary facility, wherein the control device comprises:

a network module, connected to a transmission network, a sensing module, detecting a user before the sanitary facility and generating a sensing signal, and a processing module, electrically connecting the flush valve, the network module, and the sensing module, and having at least one flush mode to control the flush valve to flush the sanitary facility, wherein the processing module receives the sensing signal and outputs flush-associated data via the network module;

wherein the control device receives at least one piece of mode setting data transferred via the transmission network, the mode setting data comprises at least one context parameter corresponding to the flush mode, the context parameter is selected from an actual measurement factor, and the control device sets the flush mode according to the mode setting data.

2. The water-saving management system for a sanitary facility according to claim 1, wherein the control device has a plurality of flush modes, the control device switches to one of the flush modes according to the mode setting data to flush the sanitary facility.

3. The water-saving management system for a sanitary facility according to claim 1, wherein the control device has a plurality of flush modes, the context parameter corresponds to one of the flush modes, and the control device flushes the sanitary facility according to the one of the flush modes corresponding to the context parameter.

4. The water-saving management system for a sanitary facility according to claim 3, wherein the context parameter is further selected from one of the following group or any combination of: a place factor, a time factor, an event factor, and a building use factor.

5. The water-saving management system for a sanitary facility according to claim 1, wherein the mode setting data is selected from one of the following group or any combination of: a flush time setting parameter, an execution person-time setting parameter, and a period/point-of-time setting parameter.

6. The water-saving management system for a sanitary facility according to claim 5, wherein the flush time setting parameter is selected from one of the following group or any combination of: forward flush time, backward flush time, intelligent backward flush time, and flush time for automatic clean flush.

7. A water-saving management system for a sanitary facility, for controlling a plurality of flush valves to flush a corresponding plurality of sanitary facilities respectively, wherein the flush valves and the sanitary facilities are located in at least one sanitary space respectively, the water-saving management system for a sanitary facility comprising:

a transmission network;

a plurality of control devices, connected to the flush valves corresponding to the sanitary facilities, wherein the control device comprises:

a network module, connected to the transmission network, a sensing module, detecting a user before the sanitary facility and generating a sensing signal, and a processing module, electrically connecting the flush valve, the network module, and the sensing module, and having at least one flush mode to control the flush valve to flush the sanitary facility, wherein the processing module receives the sensing signal and outputs flush-associated data via the network module; and at least one local server, connected to the control devices via the transmission network, wherein the local server receives the flush-associated data and transfers at least one piece of mode setting data via the transmission network, the mode setting data is based on the number of actually measured persons, and the control device sets the flush mode according to the mode setting data to flush the sanitary facility.

8. The water-saving management system for a sanitary facility according to claim 7, wherein the mode setting data is further based on one or any combination of: a place where the sanitary facility and the sanitary space are located, time, a relevant event, and a building use.

9. The water-saving management system for a sanitary facility according to claim 7, wherein each of the control devices has a plurality of flush modes, and the control device switches to one of the flush modes according to the mode setting data.

10. The water-saving management system for a sanitary facility according to claim 7, further comprising a central server connected to the local server via the Internet, wherein the local server transfers the flush-associated data to the central server.

11. The water-saving management system for a sanitary facility according to claim 7, wherein the mode setting data is selected from one of the following group or any combination of: a flush time setting parameter, an execution person-time setting parameter, and a period/point-of-time setting parameter.

12. The water-saving management system for a sanitary facility according to claim 11, wherein the period/point-of-time setting parameter is selected from one of the following group or any combination of: a time segment, a time period, an automatic clean flush interval, opening time, and closing time.

13. A water-saving management method for a sanitary facility, applied to a flush valve corresponding to at least one sanitary facility of at least one sanitary space, the method comprising:

connecting a control device to a transmission network, wherein the control device is connected to the flush valve corresponding to the sanitary facility;

outputting at least one piece of flush-associated data of the control device to the transmission network;

receiving by the transmission network at least one piece of mode setting data transferred to the control device; and setting at least one flush mode of the control device according to the mode setting data, wherein the mode setting data comprises at least one context parameter corresponding to the flush mode, the context parameter is selected from an actual measurement factor.

14. The water-saving management method for a sanitary facility according to claim 13, further comprising: calculating and outputting, according to the flush-associated data of the control device, one or any combination of : a water-saving volume, a water use volume, and a water fee.

15. The water-saving management method for a sanitary facility according to claim 13, wherein the mode setting data comprises execution person-time in intelligent water-saving.

16. The water-saving management method for a sanitary facility according to claim 13, wherein the control device has a plurality of flush modes, the context parameter corresponds to one of the flush modes, and the control device flushes the sanitary facility according to the one of the flush modes corresponding to the context parameter.

17. The water-saving management method for a sanitary facility according to claim 16, wherein the context parameter is further selected from one of the following group or any combination of: a place factor, a time factor, an event factor, and a building use factor.

18. The water-saving management method for a sanitary facility according to claim 13, wherein the mode setting data is selected from one of the following group or any combination of: a flush time setting parameter, an execution person-time setting parameter, and a period/point-of-time setting parameter.

19. The water-saving management method for a sanitary facility according to claim 18, wherein the flush time setting parameter is selected from one of the following group or any combination of: forward flush time, backward flush time, intelligent backward flush time, and flush time for automatic clean flush.

20. The water-saving management method for a sanitary facility according to claim 13, wherein the flush-associated data is transferred to a local server via the transmission network and the local server transfers the mode setting data to the control device via the transmission network.

* * * * *